US006017072A

United States Patent [19]

Grant

[11] Patent Number: 6,017,072

[45] Date of Patent: Jan. 25, 2000

[54] COMBINATION PURSE, KEY HOLDER, AND HANDGUARD

[76] Inventor: John Junior Grant, 50 Lenox Rd. Apt. 5B, Brooklyn, N.Y. 11226

[21] Appl. No.: 09/059,626

[22] Filed: Apr. 14, 1998

[51] Int. Cl.[7] ..... A45C 13/26

[52] U.S. Cl. ..... 294/146; 294/141; 294/171; 224/218; 150/107

[58] Field of Search ..... 294/146, 170, 294/171, 141, 143, 149, 165, 137, 160; 224/218, 219, 220; 150/107, 110, 190, 160; 383/6

[56] References Cited

U.S. PATENT DOCUMENTS

| | | | |
|---|---|---|---|
| 1,109,846 | 9/1914 | Knap | 294/149 |
| 1,199,635 | 9/1916 | Urmston | 224/218 |
| 1,998,554 | 10/1935 | Mills | 150/110 |
| 2,079,401 | 10/1937 | Eisenberg et al. | 150/110 |
| 2,175,327 | 5/1939 | Thornhill et al. | 150/105 |
| 3,796,357 | 3/1974 | Johnson | 294/170 |
| 4,262,385 | 4/1981 | Norman | 294/171 |
| 4,923,235 | 5/1990 | Stewart | 294/141 |
| 5,251,945 | 10/1993 | Stoops | 294/165 |
| 5,263,755 | 11/1993 | Thompson | 294/165 |
| 5,356,190 | 10/1994 | Torres | 294/171 |
| 5,487,582 | 1/1996 | Bourgeois et al. | 294/146 |

*Primary Examiner*—Robert P. Olszewski
*Assistant Examiner*—Paul Chin
*Attorney, Agent, or Firm*—Law Offices of Mitchell P. Novick

[57] ABSTRACT

A handguard comprises a key holder component and a purse component fastened to, and separable from, each other. Each component fits in a user's hand, and when used while carrying a plastic shopping bag, protects the hand from irritation etc. caused by heavily laden bags. Key holder component has a back piece and front piece stitched together to form a key compartment between them, the key compartment being open at its top edge, but closed by a flap on the back piece. Purse component has two members stitched together to form a purse compartment, which is open at the top and closed by fasteners inside the purse compartment. Each component has fasteners on their outer surfaces which fasten the key holder component to the purse component. The preferred fasteners are hook and loop fasteners. Key holder compartment has a key ring retained inside by a strap that slides through an opening at the key compartment bottom. A snap hook or D-ring is secured towards the other end of the strap by a fastener. A fastener on the strap joins another fastener on the key holder back piece outside, such that the handguard is strapped around a user's hand, or secures the two components together when the handguard is not being used as a handguard. The handguard can be used to carry keys, change, currency, credit cards, shopping list etc. so these items may be available for impromptu shopping after the user has engaged in activities such as jogging.

24 Claims, 8 Drawing Sheets

COMBINATION PURSE, KEY HOLDER, AND HANDGUARD

FIELD OF THE INVENTION

The present invention relates to devices that can be used for carrying shopping bags having strap-type handles. In addition, the present invention provides a means for carrying other items, such as keys, change, currency, credit cards or the like.

BACKGROUND OF THE INVENTION

In recent years stores have shifted from using paper bags to using plastic shopping bags for packing one's purchases. Plastic shopping bags tend to predominate, although paper bags are still available. A problem associated with carrying heavily laden plastic shopping bags is that their handles can irritate or even cut one's hands. This is more common among city dwellers where the individual has to carry their purchases over a long distance. Most merchants supplying plastic shopping bags do not provide their customers with any device to protect the customer's hands from irritation caused by carrying loaded plastic shopping bags.

In U.S. Pat. No. 5,356,190 Torres discloses a plastic bag handguard which is a folded sheet of plastic that contains a trough which retains the handles of plastic shopping bags, and which fits in a user's hand, protecting the hand against the weight of the loaded shopping bag. However, if the user wants to use more than one of these devices, they must be carried individually, in contrast to the present invention where two handguards are attached to each other and readily separable from each other.

In U.S. Pat. No. 5,263,755 Thompson describes a portable carrier for bags which has an elongated handle connected to a hinge and a parabola-shaped carrier section which is retained in the handle by a spring-loaded pull pin. In this device the handle is held in the user's hand, and the plastic bags are retained on the carrier section.

Stewart describes a handle for carrying plastic shopping bags in U.S. Pat. No. 4,923,235. The rigid elongate handle fits in a user's hand, and has a notch in each end to retain the straps of the shopping bag.

The present invention is a leather handguard that fits in a user's palm, and is designed for protecting the user's hands from irritation caused by carrying heavily laden plastic shopping bags. The present invention can be also used to carry other items having handles, such as paint cans or joint compound, items tied with string such as bundles of tied-up papers, etc.

BRIEF SUMMARY OF THE INVENTION

It is an object of the present invention to provide a handguard device that can be used to carry a shopping bag having strap-type handles.

Another object of the present invention is to provide a handguard that can be used with a variety of different shopping bags, such as those manufactured from plastic, canvas, netting or paper.

Another object of the present invention is to provide a handguard that can be used to carry keys, change, currency, credit cards or the like.

Still another object of the present invention is to provide a handguard device having components that can be readily detached from one another so that both hands of the user can be protected.

Yet another object of the present invention is to provide a handguard that can be easily and economically manufactured from sturdy and resilient materials.

Still another object of the present invention is to provide an item that can always be in the user's possession, and enable the user to have money available for impromptu shopping.

Yet another object of the present invention is to provide an item that can carry one's keys, and be worn around the hand or other parts of the user's person when engaging in athletic activities such as jogging or exercising.

The present invention is a handguard comprising a key holder component and a purse component that are fastened to, and are separable from, each other. Each component fits in a user's hand, and when used while carrying a plastic shopping bag, protects the hand from irritation etc. caused by heavily laden shopping bags. The key holder component has a back piece and front piece stitched together to form a key compartment between them, the key compartment being open at its top edge, but closed by a flap on the back piece. The purse component has two members stitched together to form a purse compartment, which is open at the top and closed by fasteners inside the purse compartment. Each component has fasteners on their outer surfaces which fasten the key holder component to the purse component. The preferred fasteners are hook and loop fasteners. The key holder compartment has a key ring retained inside by a strap that slides through an opening at the key compartment bottom. A snap hook or D-ring is secured towards the other end of the strap by a fastener. A fastener on the strap joins another fastener on the outside of the key holder back piece, such that the handguard is strapped around a user's hand, or secures the two components together when the handguard is not being used as a handguard. The handguard can be used to carry keys, change, currency, credit cards, a shopping list, memoranda etc., so these items may be available for impromptu shopping after the user has engaged in athletic activities such as jogging.

DETAILED DESCRIPTION OF THE INVENTION

The present invention is a handguard 10 (FIG. 1) for use by an individual for carrying one or more shopping bags. Handguard 10 comprises a key holder component 20 and a purse component 100 that are joined to each other by fasteners, and which can be separated into their respective components. Both key holder component 20 and purse component 100 can be used individually to protect the hand of a user. Thus, an individual can have a device which can be conveniently carried, the components readily separable from each other, and used to protect one or both of the user's hands.

Figure 1:
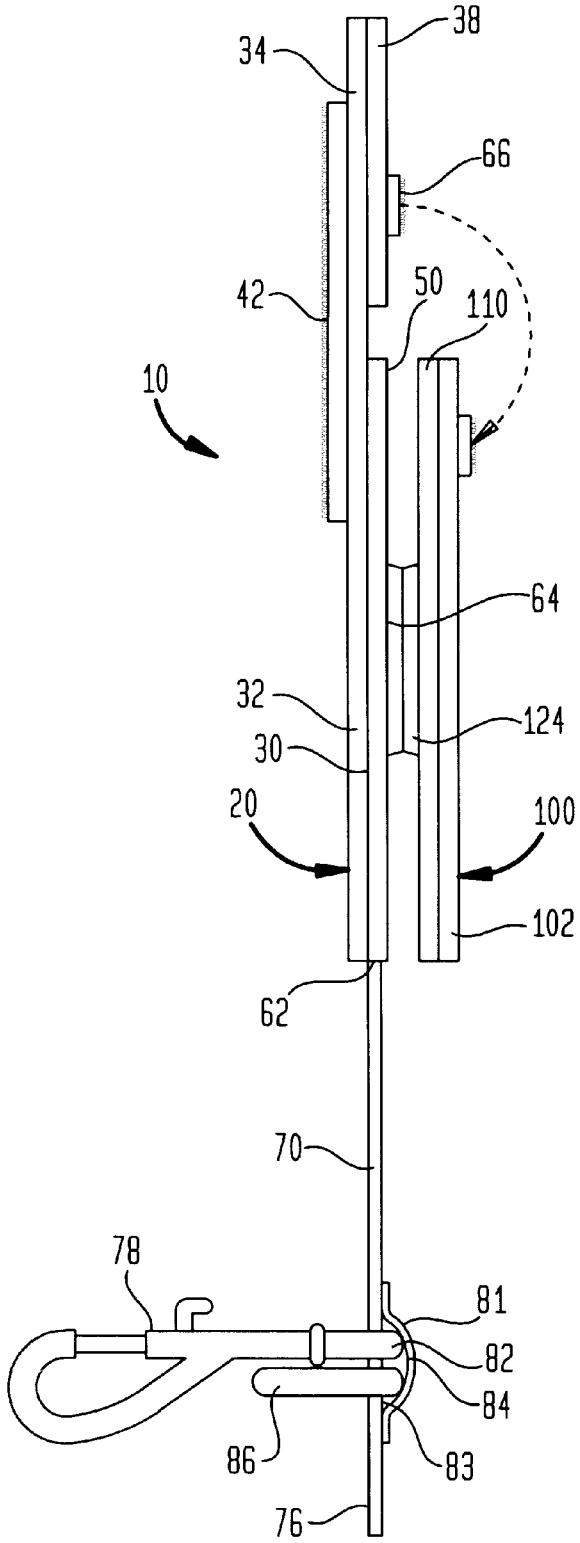
FIG. 1 is a side view of the handguard of the present invention.

Key holder component 20 comprises a back piece 30 and a front piece 50. Back piece 30 has a lower section 32 and an upper section 34. Lower section has an inner surface 33 and an outer surface 35. Upper section has an inner surface 36 and an outer surface 37. An additional piece 38 is attached to upper section inner surface 36 by stitching 39, and provides a finished surface appearance to the inside of upper section 34. Upper section 34 serves as a flap and will hereafter be referred to either as upper section 34 or flap 34. Flap 34 serves to open the key holder compartment when key holder component is being used to carry a shopping bag (see FIGS. 8 and 9), or cover the top of purse component when the two components are attached to each other as shown in FIG. 1. The broken lines in the upper part of FIG. 1 show how flap 34 folds down and covers purse compartment, thereby closing the purse compartment.

Figure 2:
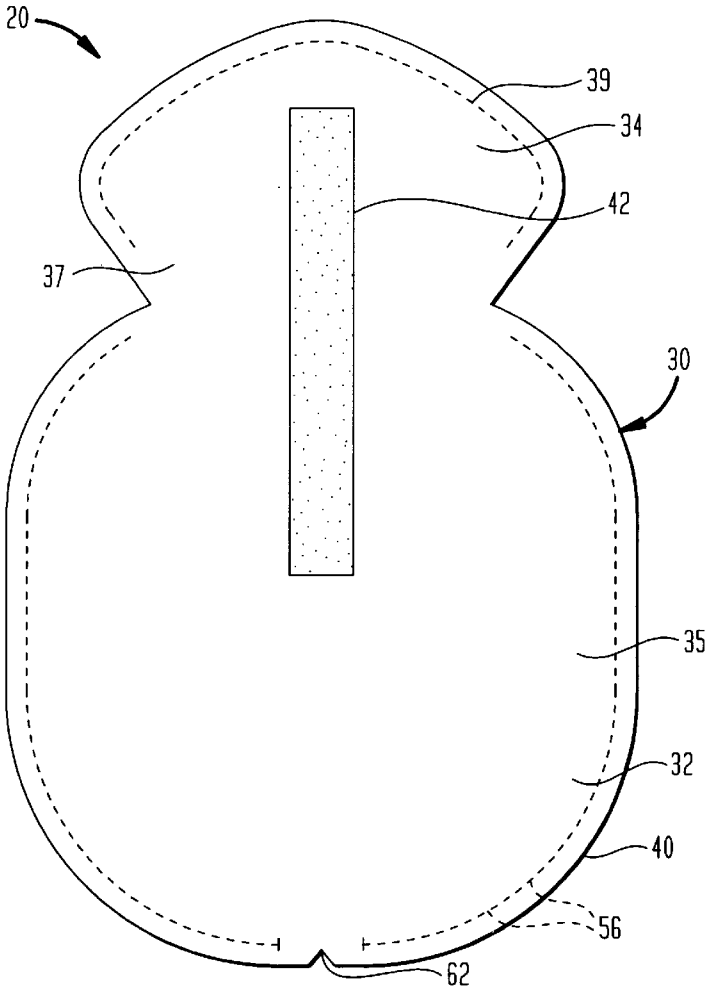
FIG. 2 is a rear perspective view of the key holder component of the present invention.

A fastener 42 is attached to back piece outer surface (FIGS. 1 and 2), with fastener 42 extending from lower section 32 to upper section 34. As will be described later, fastener 42 facilitates the attachment of key holder component 20 to purse component 100, and the attachment of strap 70 to key holder component 20 when either worn about the hand of a user or being closed and carried when not in use as a handguard.

Figure 3:
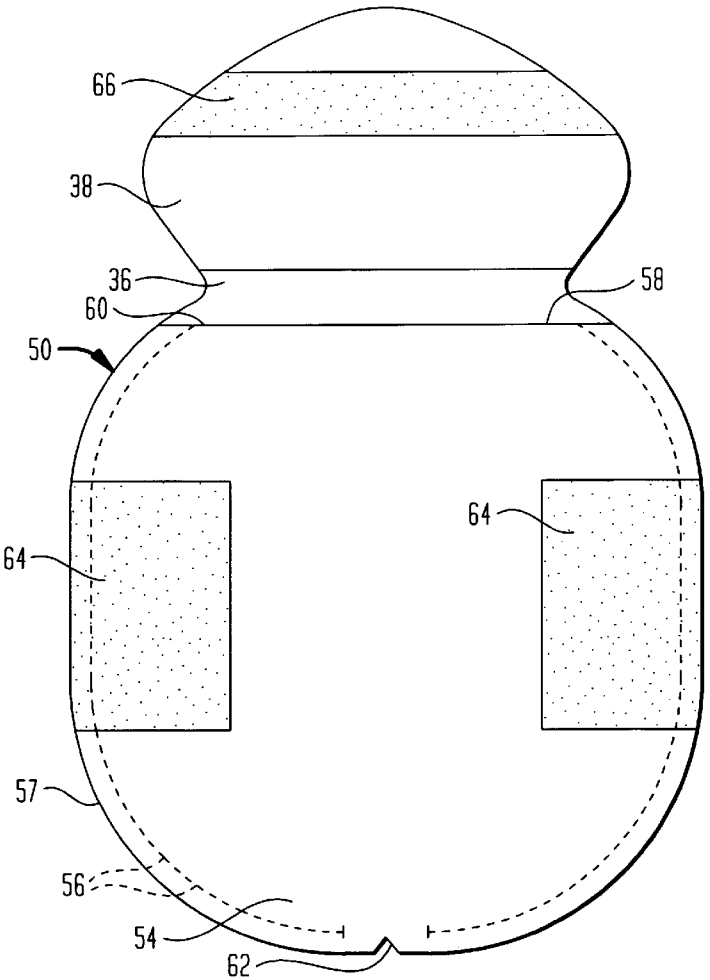
FIG. 3 is a front perspective view of the key holder component.
Figure 4:
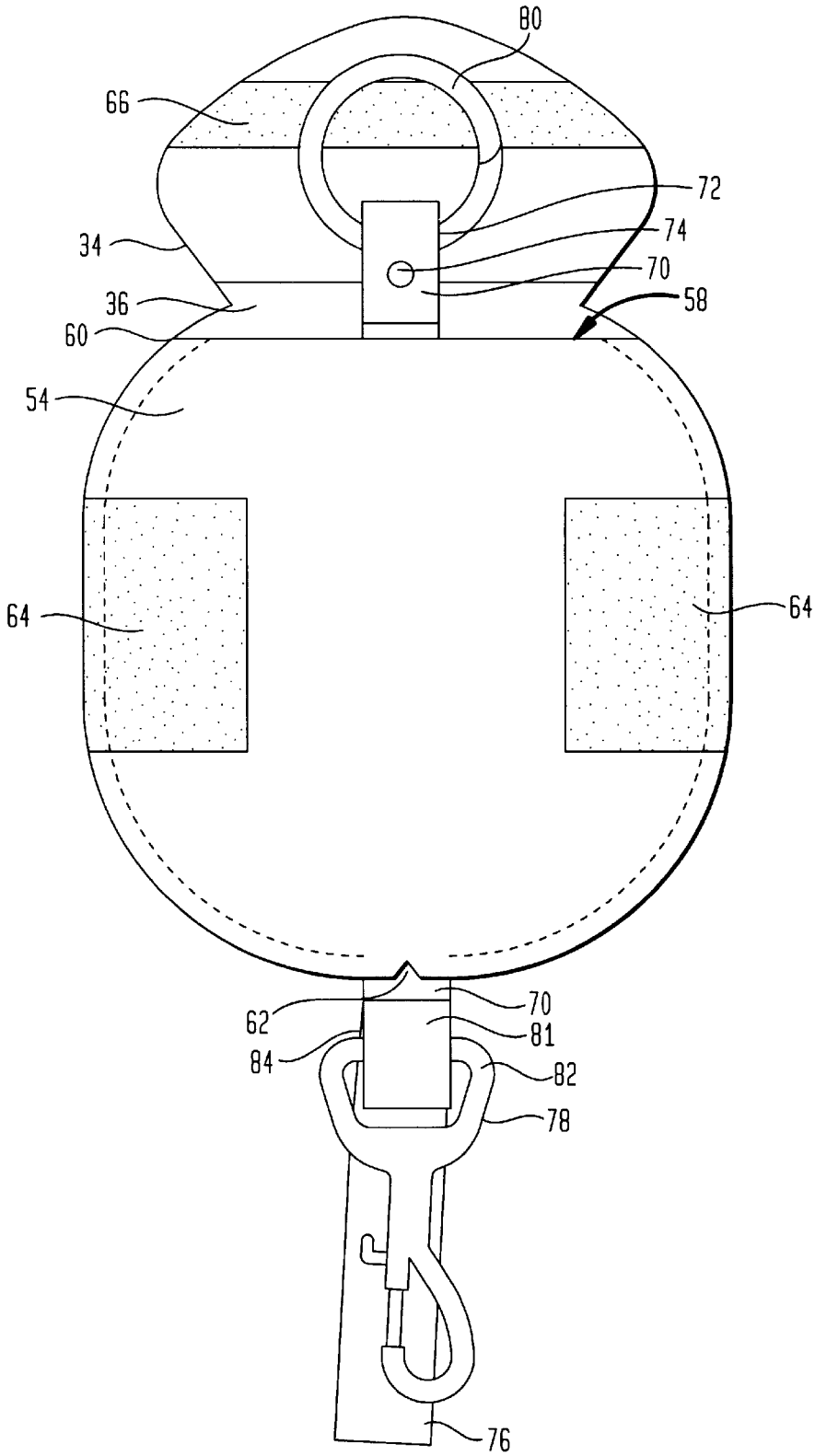
FIG. 4 is a front perspective view of the key holder component showing the key compartment in an open position and the strap partially withdrawn from the key compartment.

Front piece 50 has an inner surface 52 and outer surface 54. Back piece 30 is attached to front piece 50 by means of stitching 56 proximate the outside edges 40 and 57 of back and front piece, respectively, as shown in FIG. 3. Front piece 50 and back piece 30 are attached to each other such that back piece inner surface 32 is opposed to front piece inner surface 52, forming compartment 58 therebetween. Compartment 58 can be used to store a key or keys, or other items. Stitching 56 can completely enclose all sides except for top side 60, which is open or, there can be a gap within the stitching, creating an opening 62 at the bottom of key compartment 58 (FIG. 4). When the strap 70 is wrapped around the user's hand while carrying a shopping bag, the key holder compartment 58 is closed by flap 34.

A pair of fasteners 64 is attached to front piece outside surface 54. A third fastener 66 is attached to the inside surface of flap 34 (FIG. 3). In the preferred embodiment, these fasteners are hook and loop fasteners.

Opening 62 is sized to allow a strap 70 to slidably pass therethrough. As shown in FIG. 4, a key ring 80 is attached to strap 70 at its first end 72, key ring 80 being retained within strap 70 by a rivet 74 driven through strap 70 when first end 72 is folded back upon itself. A snap hook 78 is attached to strap 70 at a point that is towards the strap second end 76. Snap hook 78 can be used to retain another key, or may be used to connect handguard 10 to a belt loop, pocketbook strap, knapsack or the like for convenience in carrying handguard 10 when it is not being used to carry shopping bags or other items. A second key ring, snap hook or D-ring 86 (FIG. 1) or similar device can be attached proximate the first snap hook 76, such that additional keys can be attached to the handguard 10. Alternatively, handguard 10 can be worn on a belt or a strap or a finger inserted through that second ring or hook etc. A fastener 81 having an inside surface 83 attached to one side of strap 70 aids the retention of snap hook 76 and D-ring 86 by strap 70 by retaining the end 82 of snap hook 76 in the opening 84 formed between fastener 81 and strap 70. Fastener 81 is a strip of a hook and loop fastener, and is complementary to fastener 42 on first piece outer surface 38. The diameter of key ring 80 preferably is larger than the diameter of opening 62 to prevent loss of key ring 80 and any items attached to it. Key ring 80 can be a loop of wire, a split link, or other key rings known to those skilled in the art. Similarly, the diameter of snap ring end 82 should be greater than the diameter of opening 62.

Figure 8:
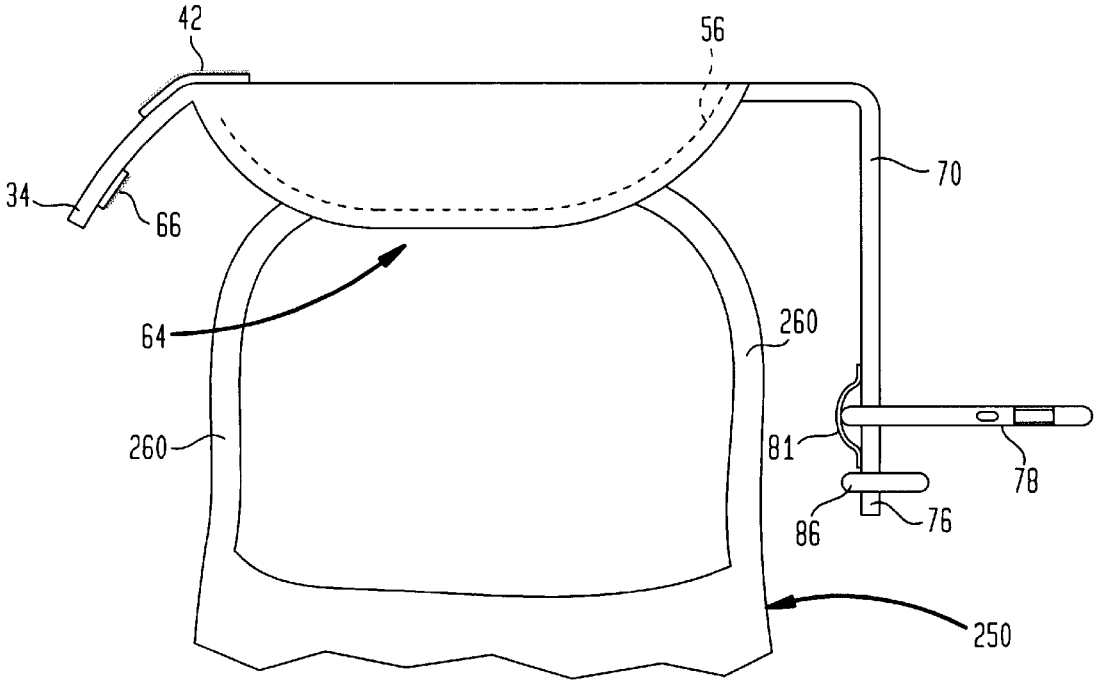
FIG. 8 is a side view of the key holder component being used to carry a shopping bag.
Figure 9:
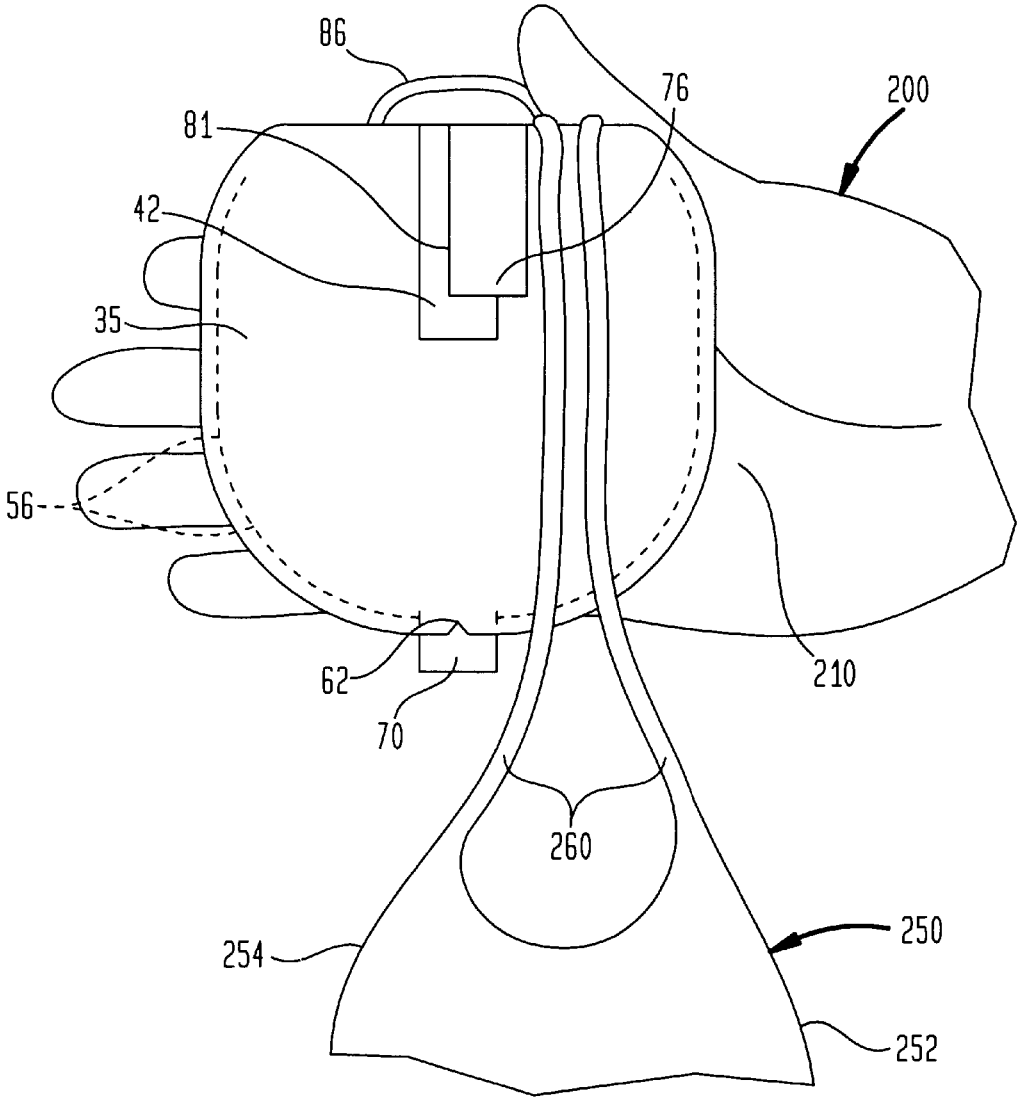
FIG. 9 depicts an alternate use of the key holder component of the present invention supporting a shopping bag held in a user's hand.

As shown in FIG. 9 key holder component 20 fits in the palm 210 of a user's hand 200, and covers a portion of the user's fingers 220. Key holder component is manufactured from a flexible material and will flex and conform to the bending of the user's hand when carrying packages. Thus key holder component will protect the user's hand and fingers although the weight of the laden shopping bag or bags deform key holder component 20. FIG. 8 illustrates a manner of using key holder component 20 to carry a shopping bag (a user's hand that would be grasping key holder component in this manner is not shown). The user holds key holder component 20 within their hand, grasps strap 260 of shopping bag 250, and flexes key holder compartment 20. Depending upon how far the user flexes key holder compartment 20, fasteners 64 (see FIG. 3) will engage each other and support the shopping bag from beneath.

FIG. 9 shows the key holder component being used with the front surface facing the user's palm, and strap 70 encircling the user's hand. In this manner key holder component is secured around the user's hand by strap 70 and fastener 80 being attached to complementary fastener 42 on key holder component back piece 30. Further, key holder compartment 20 can be used in this manner (but without any shopping bag) when the user is engaging in athletic activities, such as jogging or exercising. Depending upon the length of strap 70 and the size of the user, key holder component 20 could be secured around other parts of the user s person, such as an ankle. This attachment provides additional security to prevent the loss of the user's keys or other items that may be stored in key holder component. Shopping bag 250 has plastic side walls 252 and 254 which have loop-type straps 260, which rest atop key holder component as shown in FIG. 9. Shopping bags made from canvas, commonly referred to as "tote" bags, have a structure similar to shopping bag 250, and can also be carried using the present invention. The straps of tote bags are generally wider than those of plastic shopping bags, and because tote bags are meant to withstand repeated use, are generally constructed of a sturdier material than plastic shopping bags. Key holder component 20 may also be used without the user inserting their hand through strap 70, with front surface 50 facing away from the user's palm, or in whatever manner the user may find convenient.

Figure 5:
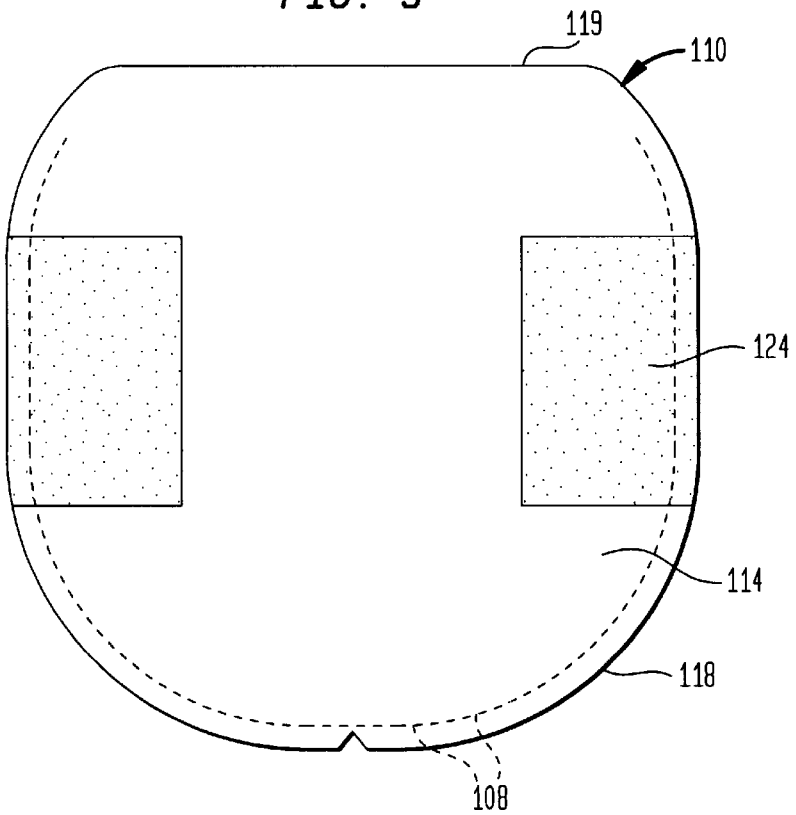
FIG. 5 is a rear perspective view of the purse compartment of the present invention.
Figure 6:
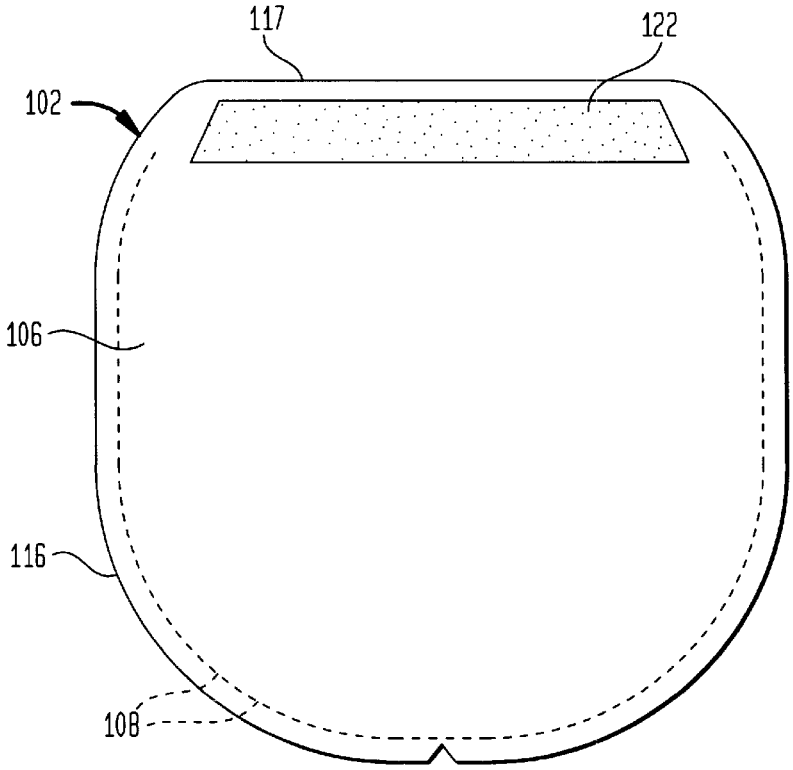
FIG. 6 is a front perspective view of the purse compartment.
Figure 7:
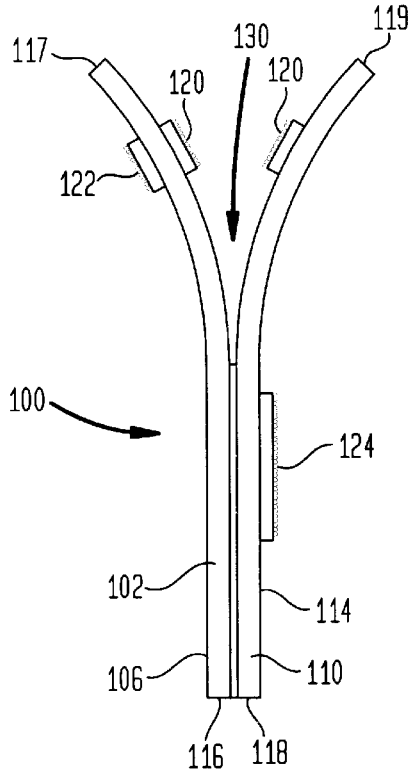
FIG. 7 is a side perspective view of the purse component in an open position.

Purse component 100 is used for carrying change, paper currency, a shopping list, credit cards, various memoranda or the like. However, credit cards or other rigid materials should not be carried in purse compartment to avoid bending and damaging them if the purse compartment will be used for a carrying a shopping bag. Purse component 100 comprises two members 102 and 110 fastened together such that a purse compartment 130 is formed therebetween, purse compartment 130 being open at the top, defined by top edges 117 and 119. Each member 102 and 110 has an inside surface 104 and 112 and outside surface 106 and 114, respectively. Purse component members 102 and 110 are attached to each other by means of stitching 108 proximate the outside edges 116 and 118 of each member, with the inside surfaces 104 and 112 of the members opposing each other (FIGS. 5–7). The structure and appearance of the inside surface of members 102 and 110 is similar to that of the outside surface of member 102 shown in FIG. 6, except that the finish of the inside surface is rough rather than smooth. Complementary fasteners, such as a strip of a hook and loop fastener 120 are attached to inside surfaces 104 and 112 of each member (FIG. 7), such that when fasteners 120 engage each other, purse compartment 130 is closed and items placed within purse compartment 130 will be retained therein. FIG. 7 shows purse component 100 with the fasteners 120 separated from each other, such that purse compartment 130 is open. Outside surface 106 of first member 102 has a fastener 122 attached to it and which is complementary to the fastener 66 attached under flap 34. Second member 110 has a pair of fasteners 124 attached thereto, which are complementary to fasteners 64 of key holder component 20. In the preferred embodiment, fasteners 124 are hook and loop fasteners that are complementary to the hook and loop fasteners 64. In the preferred embodiment, the fasteners are attached to the members via stitching, but other methods of attachment known to those skilled in the art can be used. As will be described further below, the fasteners 124 on second member 110 enable purse component 100 to be attached to the key holder component 20 by means of complementary hook and loop fasteners contained on its outer surface.

As shown in the Figures, both the size and the configuration of purse component members 102 and 110 are similar to the size and configuration of key holder component front piece 50, thus corresponding to the overall size and configuration of the lower section 32 of key holder component 20 (FIGS. 1, 3 and 5).

Figure 10:
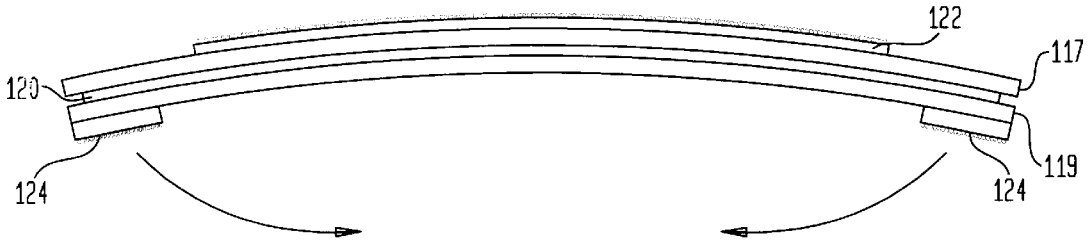
FIG. 10 is a top perspective view of the purse component in a closed position.

The broken arrows in FIG. 10 show the movement of the fasteners 124 towards each other when the user flexes purse component 100 for use in carrying a shopping bag. The surfaces of fasteners 124 engage as shown in FIG. 10, where purse compartment 100 is used in its preferred manner as a means for carrying a shopping bag. The user wraps the purse component 100 around strap 260 such that fasteners 124 engage each other and enclose the strap as shown. Purse compartment 100 acts as a handguard since the weight of the strap is still supported by the mating fasteners.

Figure 11:
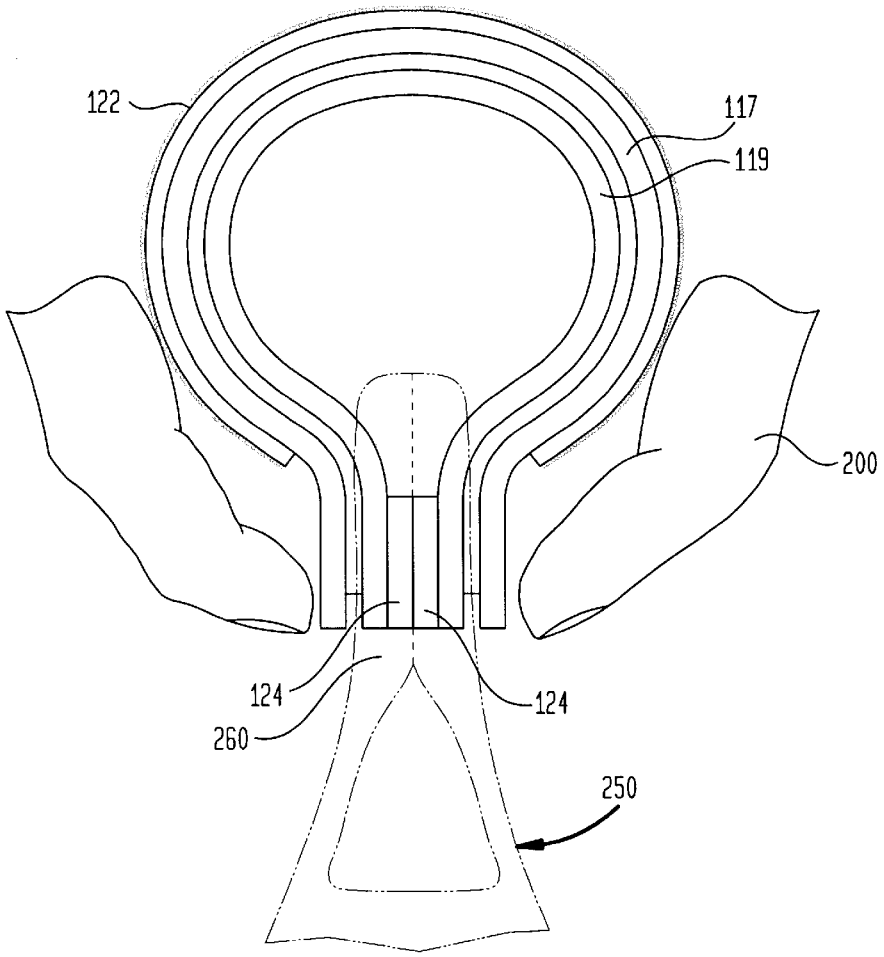
FIG. 11 depicts the purse compartment of the present invention being held in a user's hand to carry a shopping bag.
Figure 12:
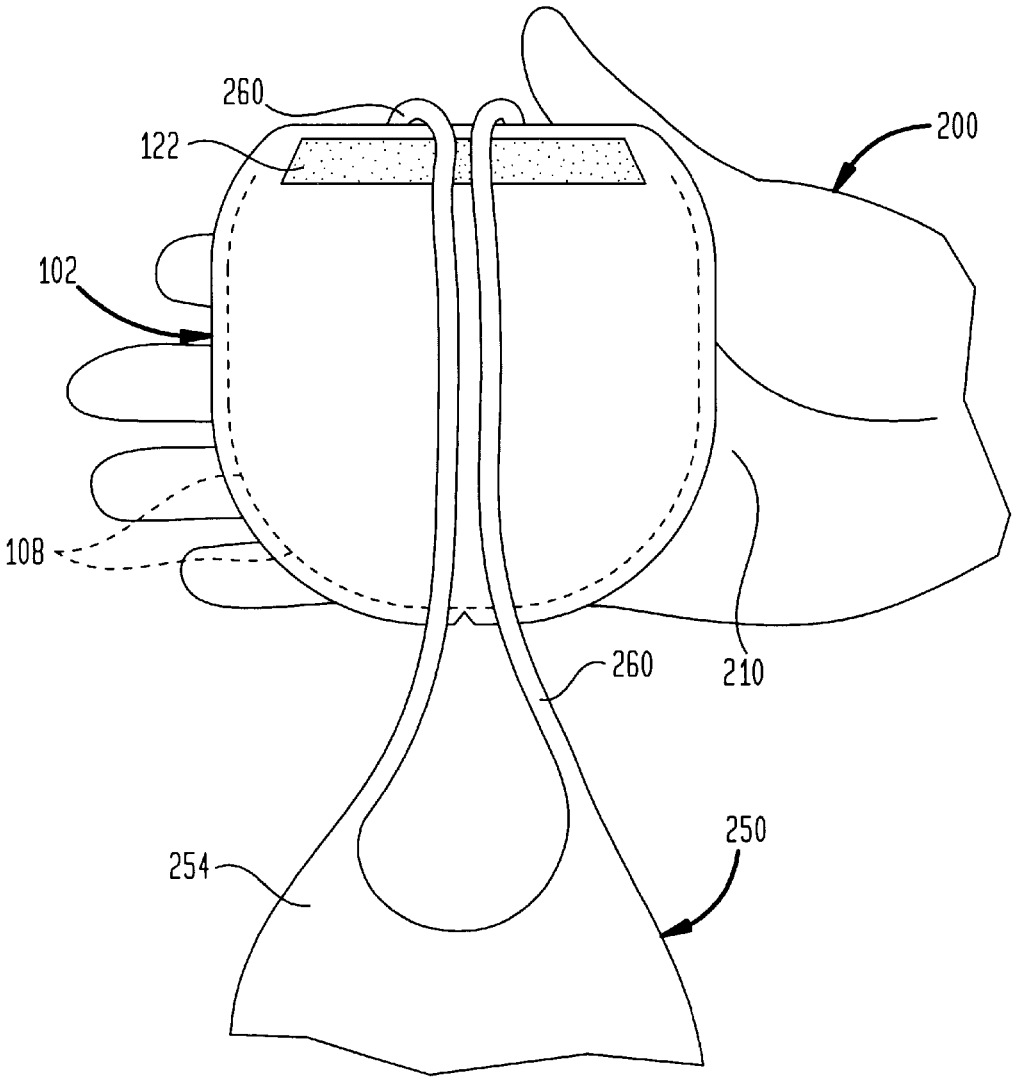
FIG. 12 depicts an alternate use of the purse compartment of the present invention supporting a shopping bag held in a user's hand.

In an alternate manner of use as a handguard (FIG. 12) the user places purse component 100 in their palm, and places strap 260 over outside surface 114. As the user closes their hand, purse compartment flexes and retains strap 260 therein. Depending upon how far the user closes their hand, the fasteners 124 will engage each other and close as shown in FIG. 11, thus protecting more of the user's hand from the weight of the loaded shopping bag or the like.

In the preferred embodiment of the present invention, both purse compartment 20 and key compartment 100 are manufactured from leather, with the thickness of back piece 20 and front piece 50, and purse component members 102 and 110 being approximately ⅛ of an inch. The inner surface of back piece, front piece and purse component members has a rough finish while the outer surface is finished smooth, but this depends on the type of material chosen to manufacture the handguard. The preferred fasteners are hook and loop type fasteners, such as VELCRO®. Strap 70 is preferably manufactured from leather, but other materials known to those skilled in the art can be substituted. Therefore, based upon the foregoing description, the present invention is a handguard which can serve as both a handguard, a key holder and a purse.

In other embodiments, two purse compartments can be attached to one another or two key compartments can be attached to one another, adding to the versatility of the present invention.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

I claim:

1. A handguard for carrying a shopping bag, the handguard comprising:

A. a first component having a back piece and a front piece, the back piece having an inner surface and an outer surface, an upper section and a lower section, the lower section having an outside edge, the upper section being a flap, the front piece having an outside edge and a top edge, the front piece attached to the lower section forming a key compartment therebetween, the front piece attached to the lower section by a means for attachment proximate their outside edges;

B. a second component having two members, the members having an outside edge and a top edge, the members attached to each other forming a purse compartment therebetween, the members attached to each other by a means of attachment proximate their outside edges, the compartment being open along the top edges; and the second component fastened to the first component by means for fastening secured to the first component front piece and to a second component member, the second component being separable from the first component, such that either the first component, the second component, or both components can be used to carry the shopping bag when the first and second components have been separated.

2. The handguard as described in claim 1, wherein the key compartment is open along the top edge and the key compartment contains an opening therein.

3. The handguard as described in claim 2, wherein the opening is opposite the top edge of the key compartment.

4. The handguard as described in claim 2, wherein the first component front piece is attached to the back piece lower section by stitching.

5. The handguard as described in claim 4, wherein the first component further comprises a means for retaining items therein.

6. The handguard as described in claim 5, wherein the means for retaining items is slidably contained within the key compartment by a strap, the strap having a first end which is secured to the means for retaining items.

7. The handguard as described in claim 6, wherein the means for retaining items is a key ring.

8. The handguard as described in claim 5, wherein the strap further comprises a second end, and a means for connecting items proximate the second end.

9. The handguard as described in claim 8, wherein the strap is slidably retained through the key compartment opening, the second end being outside the key compartment.

10. The handguard as described in claim 9, wherein the key ring is sized so it is larger than the key compartment opening.

11. The handguard as described in claim 10, wherein the means for connecting items is sized so that it is larger than the key compartment opening.

12. The handguard as described in claim 11, wherein the strap further comprises a fastener proximate the strap second end, the strap fastener engaging a means for fastening on the back piece outer surface, thereby providing a second means for fastening the key holder component to the purse component.

13. The handguard as described in claim 12, wherein the second component members each further have an inside surface and an outside surface, and a means for fastening secured to each inside surface proximate the top edge, the means for fastening closing the purse compartment, such that articles such as money, a credit card, a shopping list or memoranda can be kept in the purse compartment.

14. The handguard as described in claim 13, wherein a means for fastening is secured to each second component members' outside surface.

15. The handguard as described in claim 14, wherein the means for fastening is a hook and loop fastener.

16. The handguard as described in claim 14, wherein the means for fastening is a pair of fasteners which engage each other when the handguard is flexed, such that when the handguard is flexed around the shopping bag, the shopping bag is retained within the handguard.

17. The handguard as described in claim 16, wherein the means for connecting items is a snap hook.

18. A handguard for carrying a shopping bag, the handguard comprising:

A. a first component having a back piece and a front piece, the back piece having an upper section and a lower section, the lower section having an outside edge, the upper section being a flap, the front piece having an outside edge and a top edge, the front piece attached to the lower section forming a key compartment therebetween, the front piece attached to the lower section by a means for attachment proximate their outside edges;

B. a second component having two members, the members having an outside edge and a top edge, the members attached to each other forming a purse compartment therebetween, the members attached to each other by a means for attachment proximate their outside edges, the purse compartment being open along the top edges; and the second component fastened to the first component by means for fastening attached to the first component front piece and to one of the second component members, the second component being separable from the first component, such that either the first component, the second component or both components can be used to carry the shopping bag when the first and second components have been separated.

19. The handguard as described in claim 18, wherein the key compartment is open along the top edge and the key compartment has no opening along the outside edge.

20. The handguard as described in claim 18, wherein the second component members each further have an inside surface and an outside surface, and a means for fastening secured to each inside surface proximate the top edge, the means for fastening closing the purse compartment, such that articles such as money, a credit card, a shopping list or memoranda can be kept in the purse compartment.

21. The handguard as described in claim 20, wherein the means for fastening is secured to each second component members' outside surface.

22. The handguard as described in claim 21, wherein the means for fastening is a hook and loop fastener.

23. The handguard as described in claim 21, wherein the means for fastening is a pair of fasteners which engage each other when the handguard is flexed, such that when the handguard is flexed around the shopping bag, the shopping bag is retained within the handguard.

24. A handguard for carrying a shopping bag, the handguard comprising:

A. a key holder component having a back piece and a front piece, the back piece having an inner surface and an outer surface, an upper section and a lower section, the lower section having an outside edge, the upper section being a flap, the front piece having an outside edge and a top edge, the front piece attached to the lower section forming a key compartment therebetween, the front piece attached to the lower section by stitching proximate their outside edges, the key compartment being open along the top edge and the key compartment containing an opening therein, the opening being opposite the top edge of the key compartment;

B. a purse component having two members, the members having an inside surface and an outside surface, an outside edge and a top edge, the members attached to each other forming a purse compartment therebetween, the members attached to each other by stitching proximate their outside edges, a means for fastening secured to each members' inside surface proximate the top edge, the means for fastening closing the purse compartment, and a means for fastening secured to each members' outside surface; and C. the key holder component further having a strap retained within the key compartment, the strap slidably retained in the key compartment opening, the strap having a first end which is attached to a means for retaining keys, the means for retaining keys being sized larger than the key compartment opening, the strap further having a second end, and a means for connecting items proximate the strap second end, the means for connecting items retained on the strap by a means for fastening, the means for connecting items being sized larger than the key compartment opening; and the purse component attached to the key holder component by means for fastening secured to the key holder component front piece and to purse component member, the key holder component being separable from the purse component, such that either the key holder component, the purse component, or both components can be used to carry the shopping bag when the key holder and purse components have been separated.

* * * * *